US011199052B2

(12) United States Patent
Lake

(10) Patent No.: US 11,199,052 B2
(45) Date of Patent: Dec. 14, 2021

(54) MAGNETIC DEPTH OF CUT CONTROL

(71) Applicant: Halliburton Energy Services, Inc., Houston, TX (US)

(72) Inventor: Andrew D. Lake, Tomball, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 21 days.

(21) Appl. No.: 16/864,588

(22) Filed: May 1, 2020

(65) Prior Publication Data

US 2021/0340823 A1 Nov. 4, 2021

(51) Int. Cl.
*E21B 12/00* (2006.01)
*E21B 10/42* (2006.01)
*E21B 10/567* (2006.01)

(52) U.S. Cl.
CPC ..... *E21B 12/00* (2013.01); *E21B 10/42* (2013.01); *E21B 10/567* (2013.01)

(58) Field of Classification Search
CPC ..... E21B 12/00; E21B 10/42; E21B 10/567; E21B 10/43; E21B 10/62; E21B 10/627; E21B 10/633; E21B 7/064; E21B 10/14; E21B 10/20; E21B 10/322; E21B 47/017; E21B 47/07; E21B 47/12
See application file for complete search history.

(56) References Cited

U.S. PATENT DOCUMENTS 10,041,305 B2 * 8/2018 Jain ..... E21B 10/62
10,273,759 B2 * 4/2019 Ricks ..... E21B 10/633
2003/0166470 A1 * 9/2003 Fripp ..... F15B 20/002 507/100
2007/0221416 A1 * 9/2007 Hall ..... E21B 10/62 175/381
2009/0107722 A1 * 4/2009 Chen ..... E21B 7/064 175/25
2014/0311801 A1 * 10/2014 Jain ..... E21B 10/08 175/27
2014/0332271 A1 * 11/2014 Do ..... E21B 10/43 175/57
2014/0332283 A1 * 11/2014 Do ..... E21B 10/627 175/266
2017/0074047 A1 * 3/2017 Jain ..... E21B 7/064
2017/0268312 A1 * 9/2017 Haake ..... E21B 33/13
(Continued)

OTHER PUBLICATIONS

Baker Hughes—TerrAdapt, 2017.

*Primary Examiner* — Daniel P Stephenson
(74) *Attorney, Agent, or Firm* — Thomas Rooney; C. Tumey Law Group PLLC

(57) ABSTRACT

A magnetic depth of cut controller (DOCC) includes a housing having a body portion with a bore extending into the body portion and a depth of cut (DOC) element positioned at least partially within the bore and having a working face to engage a subterranean formation. The DOC element is moveable within the bore to extend or retract from a first end of the housing. Further, the DOCC includes a magnet secured within the bore of the housing between the DOC element and a second end of the housing. Moreover, the DOCC includes a magnetic fluid disposed within the bore of the housing between the DOC element and the second end of the housing. The magnetic fluid has a viscosity that changes responsive to proximity to the magnet to provide a variable resistance to movement of the DOC element.

20 Claims, 9 Drawing Sheets

(56) References Cited

U.S. PATENT DOCUMENTS

| | | | | |
|---|---|---|---|---|
| 2018/0030786 | A1* | 2/2018 | Dunbar | E21B 10/62 |
| 2019/0106944 | A1* | 4/2019 | Welch | E21B 10/14 |
| 2020/0095831 | A1* | 3/2020 | Etebu | E21B 47/017 |

* cited by examiner

MAGNETIC DEPTH OF CUT CONTROL

BACKGROUND

Various types of tools are used to form wellbores in subterranean formations for recovering hydrocarbons such as oil and gas lying beneath the surface. Examples of such tools include rotary drill bits, hole openers, reamers, and coring bits. One common type of rotary drill bit used to drill wellbores is known as a fixed-cutter drill bit. Generally, fixed-cutter drill bits include polycrystalline diamond ("PDC") cutters fixed to leading faces of the fix-cutter drill bit.

In conventional wellbore drilling, a fixed-cutter drill bit is mounted on the end of a drill string, which may be several miles long. At the surface of the wellbore, a rotary table or top drive may turn the drill string, including the drill bit arranged at the bottom of the hole to penetrate the subterranean formation. As the fixed-cutter drill bit rotates, the PDC cutters shear the subterranean formation. The fixed cutter drill bit may include one or more depth of cut controllers (DOCCs) to control the amount that the PDC cutters cut into the subterranean formation.

BRIEF DESCRIPTION OF THE DRAWINGS

These drawings illustrate certain aspects of some examples of the present disclosure and should not be used to limit or define the disclosure.

DETAILED DESCRIPTION

Disclosed are systems and methods for reactive depth of cut control for a drilling operation Examples may include a DOCC having a depth of control (DOC) element that extends or retracts with respect to a housing of the DOCC in response to external forces on the DOC element. Forces applied to the DOC element may be caused by contact between the DOC element and a subterranean formation. A compressive strength of the subterranean formation may vary along a drilling path for a fixed cutter drill bit. Typical subterranean formations generally have a relatively low compressive strength in upper portions (e.g., lesser drilling depths) of the subterranean formation and a relatively high compressive strength in lower portions (e.g., greater drilling depths) of the subterranean formation. As the compressive strength may vary (e.g., along the depth of the wellbore), the forces applied to the DOC element may also vary. To provide the reactive depth of cut control for the drilling operation, the DOCC may extend or retract in response to the varying external forces on the DOC element. Further, the DOCC may provide variable resistance to movement (e.g., extension or retraction) of the DOC element via interactions between a magnetic fluid and a magnetic field in the sleeve, in response to the varying external forces on the DOC element, to provide reactive depth of cut control. Systems and methods providing reactive depth of cut control may reduce stick-slip or other issues that may damage parts of the drill string and/or hinder the efficiency of drilling operations.

Figure 1:
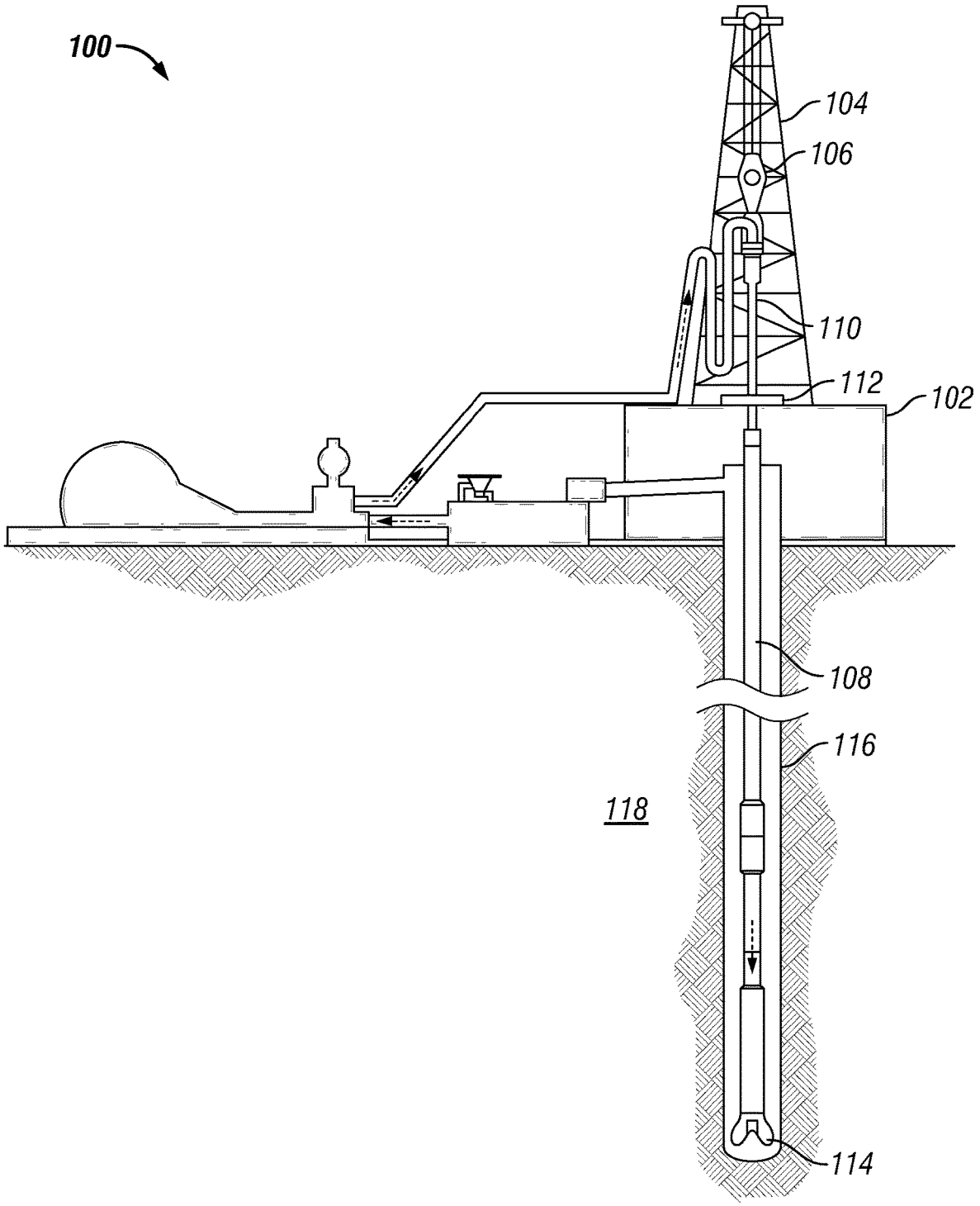
FIG. 1 illustrates a side elevation, partially cross-section view of an operational environment for a drilling system employing the principles of the present disclosure.

FIG. 1 is a side elevation, partially cross-section view of an operational environment for a drilling system in accordance with one or more embodiments of the disclosure. While FIG. 1 generally depicts a land-based drilling assembly, those skilled in the art will readily recognize that the principles described herein are equally applicable to subsea drilling operations that employ floating or sea-based platforms and rigs, without departing from the scope of the disclosure. As illustrated, the drilling assembly 100 includes a drilling platform 102 that supports a derrick 104 having a traveling block 106 for raising and lowering a drill string 108. The drill string 108 includes, but is not limited to, drill pipe, as generally known to those skilled in the art. A kelly 110 is lowered through a rotary table 112 and can be used to transmit rotary motion from the rotary table to the drill string 108. A drill bit 114 is attached to the distal end of the drill string 108 and can be driven by a downhole motor and/or via rotation of the drill string 108. As the drill bit 114 rotates, it penetrates various subterranean formations 118 to create a wellbore 116. The drill bit 114 may be of a generally fixed-cutter type configuration, having a plurality of cutters at fixed locations on the bit body, as well as one of more depth of cut controllers (DOCCs) for controlling an amount that the plurality of cutters cut into the subterranean formation 118 (e.g., a depth of cut) as further detailed below.

Figure 2:
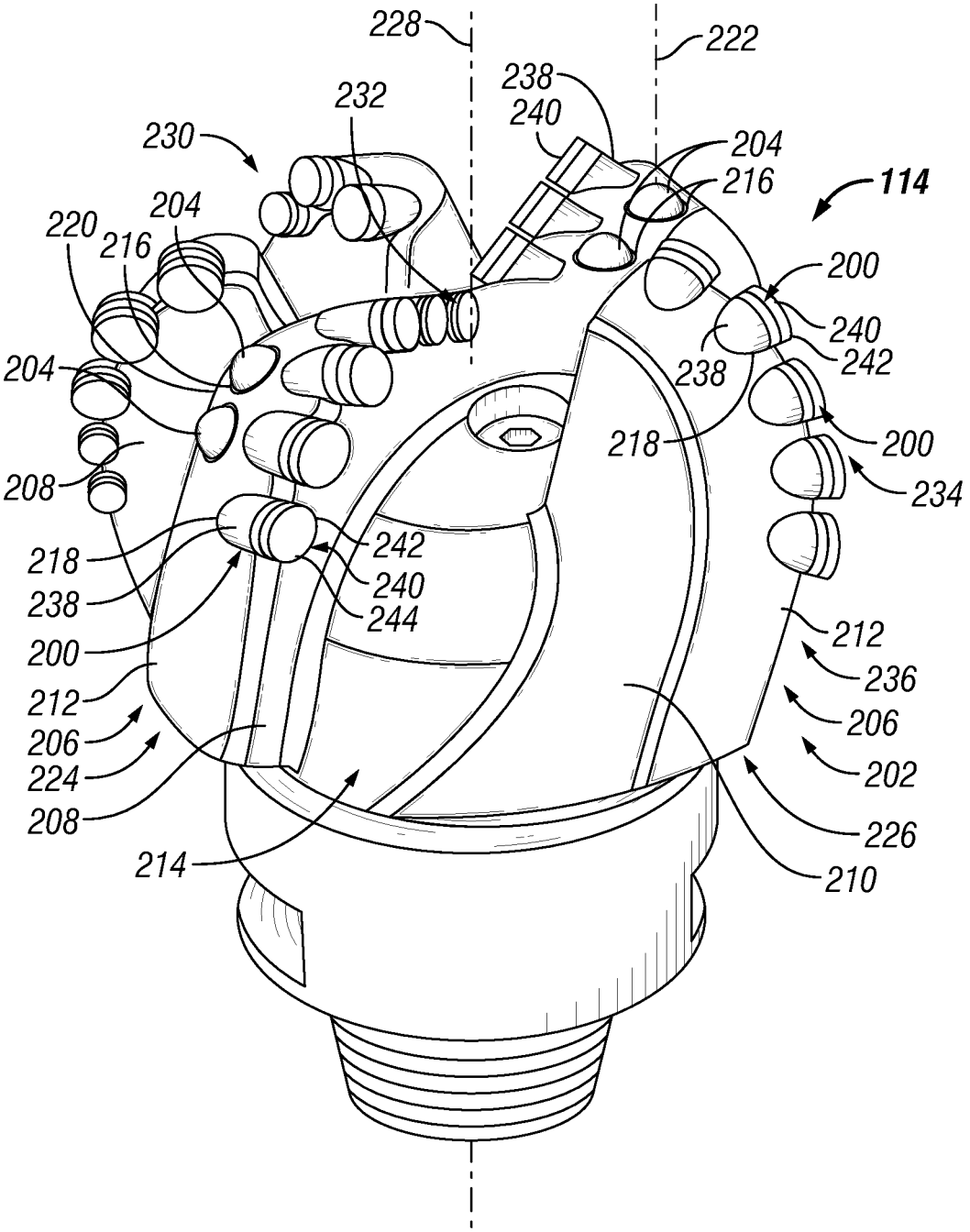
FIG. 2 illustrates an isometric view of an example of a drill bit employing the principles of the present disclosure.

FIG. 2 is an isometric view of an example of a drill bit 114 employing the principles of the present disclosure. The drill bit 114 has a plurality of cutting elements (e.g., fixed cutters 200) to penetrate various subterranean formations 118. Generally, the fixed cutters 200 are positioned about a bit body 202 of the drill bit 114 at particular locations and angular positions and may function to shear the various subterranean formations 118 as drill bit 114 rotates. To control the cutting depth of the fixed cutters 200 into the subterranean formation 118 (e.g., the depth of cut), the drill bit 114 further includes the DOCCs 204 positioned on the bit body 202. The DOCCs 204 provide sufficient surface area to engage the subterranean formation 118 without exceeding the compressive strength of the formation 118. This may remove or reduce the force applied to the fixed cutters 200 and limit their depth or engagement, which may reduce a risk of stick-slip, whirl, or other conditions that may cause damage to the drill bit 114 or hinder efficiency of drilling operations.

As illustrated, the bit body 202 of the fixed-cutter drill bit 114 includes radially and longitudinally extending blades 206. The bit body 202, including the blades 206, may be made of a steel or metal-matrix composite of a harder material (e.g., tungsten carbide reinforcing particles dispersed in a binder alloy). The blades 206 have leading faces 208 oriented toward a direction of rotation of the drill bit, trailing faces 210 oriented opposite the direction of rotation of the drill bit, and exterior faces 212 oriented outward with respect to the bit body 202. The blades 206 are spaced apart from each other on the exterior of the bit body 202 to form fluid flow paths (e.g., junk slots 214) between leading faces 208 and trailing faces 210 of adjacent blades 206.

The blades 206 include various pockets (e.g., controller pockets 216 and cutter pockets 218) formed in the exterior faces 212, the leading faces 208, and/or the trailing faces 210 of the blades 206. As illustrated, the DOCCs 204 are secured within corresponding controller pockets 216 formed in the exterior 212 and/or trailing faces 210 of the blades 206. The DOCCs 204 are positioned on the blades 206 to trail corresponding fixed cutters 200. However, the controller pockets 216 and corresponding DOCCs 204 may be positioned on any portion of the bit body 202. As set forth in detail below, the DOCCs 204 include various components, disposed within respective housings of the DOCCs 204, to provide a reactive depth of cut control for the drill bit 114. Moreover, the controller pockets 216 are each shaped and positioned to receive at least a portion of a respective housing (e.g., a sleeve 220) of the DOCCs 204, such that the sleeves 220 are at least partially secured within respective controller pockets 216. The sleeves 220 may be at least partially secured within the controller pockets 216 via brazing, threading, shrink-fitting, and/or press-fitting. Further, the DOCCs 204 each have a central axis 222 that, by virtue of their placement in corresponding pockets 212, generally transverse to a generally circular overall profile of the blades 206 swept by the bit body 202 as it rotates, to orient the DOCC 204 at a particular angle of engagement with respect to the subterranean formation 118.

Generally, during drilling operations, the drill bit 114 encounters layers of geological formations 118 that have various compressive strengths. As such, the drill bit 114 may be constantly exposed to changes in compressive strengths. When the drill bit 114 bores through a layer of the subterranean formation 118 with a lower compressive strength (e.g., soft formation layer), the fixed cutters 200 are able to withstand a relatively large depth of cut and high ROP. However, when drill bit 114 transitions from the soft formation layer to a harder formation layer, an abrupt increase in external forces may be exerted on fixed cutters 200, which may increase a risk for stick-slip, whirl, or other conditions that may cause damage to the drill bit 114 or hinder efficiency of drilling operations if a similar depth of cut is maintained. Thus, the one or more DOCCs 204 may extend or retract to pre-vent fixed cutters 200 from experiencing an excessive depth of cut and/or to dampen undesired vibrations when transitioning from a softer formation layer to a harder formation layer. In particular, a depth of cut (DOC) element of the DOCC 204 extends or retracts with respect to a corresponding housing (e.g., sleeve 220), thereby, engaging with the subterranean formation 118 and moving across the subterranean formation 118 to limit the depth to which fixed cutters 200 can engage with the subterranean formation 118 and/or dampen undesired vibrations. As illustrated in FIG. 2, the DOCCs 204 provide depth of cut control for fixed cutters 200 located in the proximity of the respective DOCCs 204. Alternatively, the DOCCs 204 may be positioned to provide depth of cut control for fixed cutters 200 located anywhere on drill bit 114.

Moreover, the blades 206 of the drill bit 114 include at least one primary blade 224 and at least one secondary blade 226. The primary blade 224 extends from a central axis 228 of the drill bit 114. The secondary blade 226 includes any other blade 206 of the drill bit 114 that does not extend from the central axis 228 of the drill bit 114. Although the illustrated embodiment shows the drill bit 114 having two primary blades 224 and three secondary blades 226 by way of example, the drill bit 114 may include any number of primary blades 224 or secondary blades 226 insofar as those blades may be fit on the bit body 202. During drilling operations, the primary blade 224 may be configured to support a majority of the weight-on-bit. To control the depth of cut of the drill bit 114, the DOCCs 204 are positioned on the primary blades 224. Alternatively, or additionally, one or more of the DOCCs 204 may be positioned on the secondary blades 226.

Further, during drilling operations, a nose area 230 of the primary blades 224 may support the majority of the weight-on-bit. That is, the nose area 230 may support a greater portion of the weight-on-bit than a cone area 232, a shoulder area 234, or a gauge area 236 of the drill bit 114. To control the depth of cut of the drill bit 114, one or more of the DOCCs 204 are disposed on or within the nose area 230 of the primary blades 224. Alternatively, the DOCCs 204 may be disposed within any area of the drill bit 114. For example, the drill bit 114 may include DOCCs 204 disposed within the cone area 232, the shoulder area 234, or the gauge area 236 of the bit body 202.

As set forth above, the blades 206 include cutter pockets 218 formed in the exterior faces 212, the leading faces 208, and/or the trailing faces 210 of the blades 206. As illustrated, the fixed cutters 200 are secured within corresponding cutter pockets 218 formed in the leading faces 208 and/or exterior faces 212 of the blades 206. Each of the fixed cutters 200 will typically be secured within its respective cutter pocket 218 via brazing. Alternatively, the fixed cutters 200 may be secured at least partially within the respective fixed-cutter pocket 218 via threading, shrink-fitting, press-fitting, or any other suitable manufacturing or assembly method for fixedly securing the fixed cutters 200 to the bit body 202 such that the fixed cutter does not move with respect to the bit body 202 even while drilling. As set forth above, each of the fixed cutters 200 may be secured within the fixed-cutter pocket 218 at a predetermined angular orientation to position the fixed cutter 200 at a desired angle with respect to the subterranean formations 118 being penetrated. As the drill bit 114 is rotated, the fixed cutter 200 is driven through the subterranean formation 118 by the combined forces of the weight-on-bit and the torque experienced at the drill bit 114 to shear the various subterranean formations 118.

The fixed cutters 200 may each include a substrate 238 made of an extremely hard material (e.g., tungsten carbide) and a cutter 240 secured to the substrate 238. The fixed cutters 200 may each include one or more layers of an ultra-hard material, such as polycrystalline diamond, polycrystalline cubic boron nitride, impregnated diamond, etc., which generally forms a cutting edge 242 and a working face 244 for each cutter 240. The working face 244 is typically flat or planar. To form the cutter 240, the substrate 238 may be placed adjacent a layer of ultra-hard material particles, such as diamond or cubic boron nitride particles, and the combination is subjected to high temperature at a pressure where the ultra-hard material particles are thermodynamically stable. This results in recrystallization and formation of a polycrystalline ultra-hard material layer, such as a polycrystalline diamond or polycrystalline cubic boron nitride layer, directly onto the upper surface of the substrate.

Figure 3:
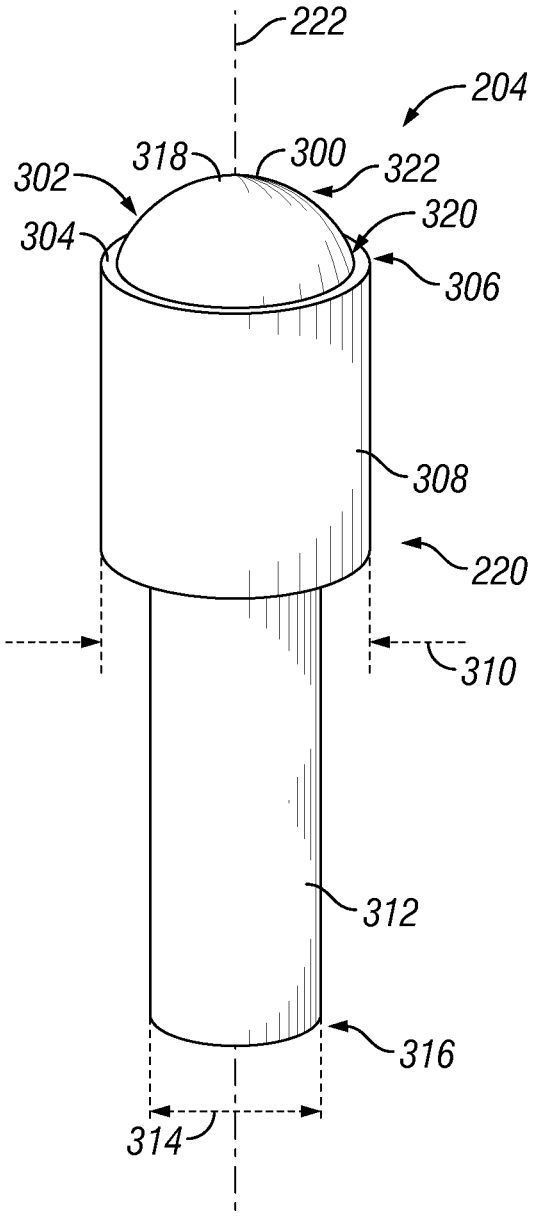
FIG. 3 illustrates an isometric view of the depth of cut controller (DOCC) employing the principles of the present disclosure.

FIG. 3 illustrates an isometric view of the depth of cut controller (DOCC) 204. As set forth above in FIG. 2, DOCCs 204 are secured within corresponding controller pockets 216 formed in the exterior 212 and/or trailing faces 210 of the blades 206. Specifically, the housing (e.g., sleeve 220) of the DOCC 204 is secured within the corresponding controller pocket 216 (e.g., referring to FIG. 2). The sleeve 220 houses various components to provide reactive depth of cut control for the DOCC 204. In the illustrated embodiment, the DOCC 204 includes the depth of cut (DOC) element 300 positioned at least partially within the sleeve 220. Generally, the sleeve 220 includes an optionally cylindrical shape with an axially-extending interior space, generally referred to herein as axial bore 302, extending into a body portion 304 of the sleeve 220 from a first end (e.g., distal end 306) of the housing (e.g., sleeve 220). The axial bore 302 may be formed by any suitable manufacturing method, including but not limited to boring, molding, or other forming techniques. Additionally, the sleeve 220 may include any of a variety of shapes, including but not limited to the optionally cylindrical shape shown. For example, the sleeve 220 may include portions with other cross-sections (e.g., squares, triangles, ovals, etc.) to prevent rotation of the sleeve 220 of the DOCC 204 within the corresponding controller pocket 216. In another example, the sleeve includes an hourglass shape having a variable outer diameter. In the illustrated embodiment, the sleeve 220 includes a first cylindrical portion 308 with a first outer diameter 310 and a second cylindrical portion 312 with a second outer diameter 314. The first cylindrical portion 308 is formed proximate the distal end 306 of the sleeve 220 and the second cylindrical portion 312 is formed proximate a second end (e.g., proximal end 316) of the housing (e.g., sleeve 220). Further, the first outer diameter 310 of the first cylindrical portion 308 is greater than the second outer diameter 314 of the second cylindrical portion 312. Moreover, the first cylindrical portion 308 is coaxial with the second cylindrical portion 312 such that the axial bore 302 extends into the body portion 304 of the sleeve 220 (e.g., the first 308 and/or second portions 312) along the central axis 222 of the DOCC 204, which is coaxial with the sleeve 220, the first cylindrical portion 308, and the second cylindrical portion 312.

The DOC element 300 is positioned at least partially within the axial bore 302 of the sleeve 220. The DOC element 300 includes a working face 318 made of one or more layers of an ultra-hard material, such as polycrystalline diamond, polycrystalline cubic boron nitride, impregnated diamond, etc. The working face 318 is configured to engage the subterranean formation 118 (e.g., referring to FIG. 1) via extending or retracting with respect to the sleeve 220. That is, the DOC element 300 slides along the central axis 222 of the sleeve 220 and/or DOCC 204 to retract or extend the working face 318 such that the working face 318 engages the subterranean formation 118. Moreover, the DOC element 3X) may include a substrate 320, which may be made of an extremely hard material such as tungsten carbide. The working face 318 may be secured to the substrate 320 via brazing or any other suitable manufacturing or assembly method for fixedly securing the working face 318 to the substrate 320 such that the working face 318 does not move with respect to the substrate 320 during drill operations. Alternatively, the DOC element 300 may include a single body having a uniform material composition of tungsten carbide, poly crystalline diamond, polycrystalline cubic boron nitride, or impregnated diamond, with a distal end 322 of the DOC element 300 forming the working face 318.

Figure 4:
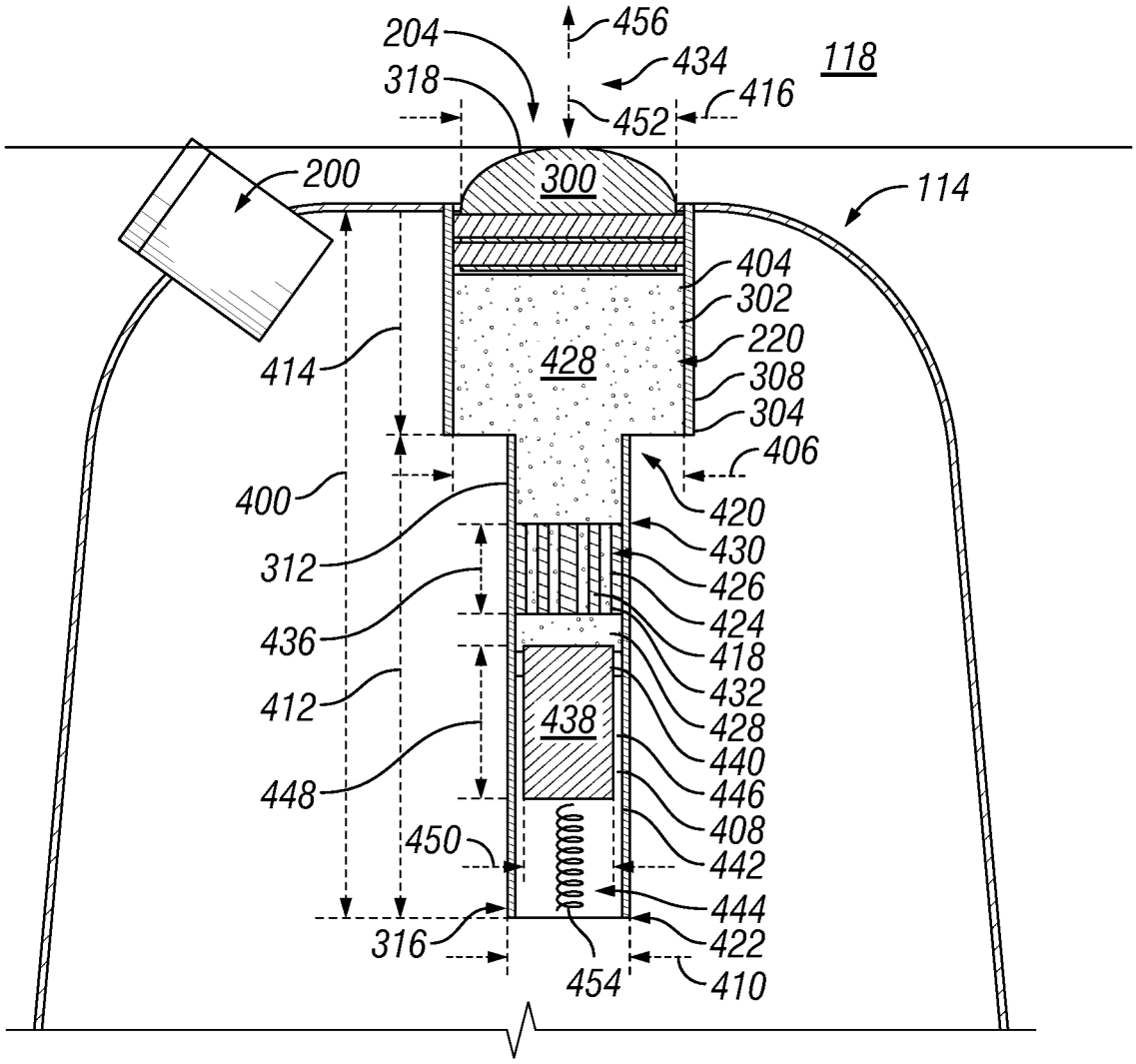
FIG. 4 illustrates a cross-sectional view of the drill bit having the depth of cut controller (DOCC) of FIG. 3 with a depth of cut (DOC) element in an extended position.

FIG. 4 illustrates a cross-sectional view of the drill bit having the depth of cut controller (DOCC) 204 of FIG. 3 with the DOC element 300 in an extended position. As set forth above, the DOCC 204 provides reactive depth of cut control for fixed cutters 200 of the drill bit 114. That is, the DOCC 204 includes the depth of cut (DOC) element 300 that extends and retracts with respect to the housing (e.g., sleeve 220) of the DOCC 204, in real-time, in response to external forces acting on the working face 318 of the DOC element 300 to control the depth of cut for the fixed cutters 200 and limit the external forces exerted on the fixed cutters 200. As set forth in detail below, the DOCC 204 controls movement of the DOC element 300 (e.g., extension and retraction) via providing a variable resistance to movement of the DOC element 300 in response to the external forces. The external forces acting on the working face 318 and the fixed cutters 200 originate from contact of the working face 318 and/or the fixed cutters 200 with the subterranean formation 118. A magnitude of the external forces on the working face 318 is based on various factors such as rate of penetration (ROP), weight-on-bit (WOB), torque-on-bit (TOB), revolutions per minute (RPM), or other drilling parameters. Other factors such as height, shape, and other characteristics of the DOC element 300 may also affect the magnitude of the external forces on the working face 318 of the DOC element 300.

The external forces urge the DOC element 300 to retract with respect to the housing (e.g., sleeve 220) of the DOCC 204. As illustrated, the sleeve 220 includes the first cylindrical portion 308 and the second cylindrical portion 312, the first cylindrical portion 308 having a greater outer diameter than the second cylindrical portion 312. Moreover. The DOCC 204 includes the axial bore 302 extending into the body portion 304 of the sleeve 220. The axial bore 302 extends into the first cylindrical portion 308 and the second cylindrical portion 312 of the sleeve 220. Alternatively, the housing is formed in the bit body 202 such that the sleeve 220 is not necessary. That is, the axial bore 302 may extend directly into the bit body 202 such that the bit body 202 forms the housing for other components of the DOCC. The axial bore 302 may be formed in the bit body 202 via machining, casting, or additive manufacturing.

The axial bore 302 has a variable diameter along a length 400 of the axial bore 302. That is, a diameter 402 of the axial bore 302 decreases along the length 400 of the axial bore 302 from the distal end 306 of the sleeve 220 in a direction toward a proximal end 316 of the sleeve 220. Alternatively, the variable diameter may increase in the directions towards the proximal end 316 of the sleeve 220 and the distal end 306 of the sleeve 220 from a central portion of the sleeve 220 to form an axial bore 302 having an hourglass shape. However, as illustrated, the axial bore 302 includes a first portion 404 having a first bore diameter 406, and a second portion 408 having a second bore diameter 410. The first portion 404 of the axial bore 302 extends through the first cylindrical portion 308 of the sleeve 220 such that the first portion 404 is positioned proximate the distal end 306 of the sleeve 220. The second portion 408 extends along the second cylindrical portion 312 of the sleeve 220 such that the second portion 408 is positioned proximate the proximal end 316 of the sleeve 220. Moreover, the first bore diameter 406 of the first portion 404 of the axial bore 302 is greater than the second bore diameter 410 of the second portion 408 of the axial bore 302. Further, a length 412 of the second portion 408 is greater than a length 414 of the first portion 404 of the axial bore 302. The second portion 408 having a smaller diameter and greater length than the first portion 404 may increase the effectiveness of DOCC 204 in controlling movement of the DOC element 300.

As illustrated in FIG. 4, the DOC element 300 is positioned in the extended position. That is, the DOC element 300 is extended outward from the sleeve 220 and blade of the drill bit 114 to engage the subterranean formation 118. In the extended position, a portion of the DOC element 300 remains within the axial bore 302 such that the sleeve 220 may retain the DOC element 300. As illustrated, the portion of the DOC element 300 retained by the sleeve 220 is positioned within the first portion 404 of the axial bore 302. An element diameter 416 of the DOC element 300 is less than the first bore diameter 406 of the first portion 404 of the axial bore 302 such that the DOC element 300 may fit within the first portion 404 of the axial bore 302 and move within the axial bore 302 to extend or retract with respect to the sleeve 220. However, the element diameter 416 of the DOC element 300 is greater than the second bore diameter 410 of the second portion 408 of the axial bore 302 such that the DOC element 300 may only move along the first portion 404 of the axial bore 302.

The DOCC 204 includes various components to control movement of the DOC element 300 such that the DOCC 204 may effectively provide depth of cut control and limit the external forces exerted on the fixed cutters 200. The DOCC 204 includes a magnet 418 secured within the axial bore 302 of the sleeve 220 between the DOC element 300 and the proximal end 316 of the sleeve 220. In the illustrated embodiment, the magnet 418 is a rare earth magnet (e.g., neodymium magnet or samarium-cobalt magnet). Alternatively, the magnet 418 may be an electromagnet as set forth in detail below. Further, the magnet 418 may be permanent or temporary. The magnet 418 is secured within the second portion 408 of the axial bore 302 between a distal end 420 of the second portion 408 and a proximal end 422 of the second portion 408. Alternatively, the magnet 418 may be secured within the first portion 404 of the axial bore 302. In examples, the magnet 418 has a generally cylindrical shape. To secure the magnet 418, the magnet 418 may be threaded into a portion of the sleeve 220 having corresponding threads. Securing the magnet 418 via threads may reduce an amount of heat transfer to the magnet 418, which may increase the effectiveness of the magnet 418 and/or reduce wear on the magnet 418. Alternatively, the magnet 418 may be secured between adjacent axial portions of the two-piece sleeve 220. For example, the two-piece sleeve 220 may be shaped such that the magnet 418 may be placed between and held by the adjacent axial portions of the sleeve 220. In another example, the magnet 418 may be press fit within the second portion 408 of the axial bore 302. However, the magnet 418 may be secured within the axial bore 302 by any suitable means.

The magnet 418 includes multiple through bores 424 that form fluid passageways 426 through the magnet 418 that permit a magnetic fluid 428 to flow between a distal end 430 of the magnet 418 and a proximal end 432 of the magnet 418. Alternatively, the magnet 418 may include a single through bore extending through a central axis of the magnet 418 in an axial direction 434 such that the magnet 418 has an annular ring shape (e.g., donut shape). Moreover, the through bores 424 extend through the magnet 418 from the distal end 430 of the magnet 418 to the proximal end 432 of the magnet 418 in the axial direction 434. The through bores 424 are positioned in a pattern that spaces the through bores 424 evenly apart from each other. However, the through bores 424 may be non-evenly spaced in some patterns. Further, the through bores 424 have circular cross-sections. Alternatively, the through bores 424 may have any suitable cross-section (e.g., triangular, square, ovular, etc.). As illustrated, the through bores 424 have uniform cross-sections along axial lengths 436 of the through bores 424.

Moreover, the DOCC 204 includes the magnetic fluid 428 (e.g., ferrofluid, magnetorheological fluid, etc.) housed within the bore of the sleeve 220 between the DOC element 300 and the proximal end 316 of the sleeve 220. Specifically, the magnetic fluid 428 is housed in the bore between the DOC element 300 and a piston 438 of the DOCC 204. A seal 440 is disposed between the piston 438 and a borehole wall 442 of the second portion 408 of the axial bore 302 to prevent the magnetic fluid 428 from passing around the piston 438 into an end portion 444 of the second portion 408 of the axial bore 302 disposed between the piston 438 and the proximal end 316 of the sleeve 220. The seal 440 includes a rubber ring having sufficient thickness to seal a gap 446 between the piston 438 and the borehole wall 442. However, any suitable seal 440 may be used to seal the gap 446.

Moreover, the piston 438 is cylindrical with a uniform cross-section along an axial length 448 of the piston 438. A piston diameter 450 of the piston 438 is substantially similar to the second bore diameter 410 to help maintain axial alignment of the piston 438 within the second portion 408 of the axial bore 302 as the piston 438 moves within the second portion 408 of the axial bore 302. The piston 438 is configured to move along the second portion 408 of the axial bore 302 between the magnet 418 and the proximal end 316 of the sleeve 220. The external forces on the working face 318 of the DOC element 300 may cause the DOC element 300 to move in the direction 452 toward the proximal end 316 of the sleeve 220. As the DOC element 300 moves, the DOC element 300 pushes the magnetic fluid 428, which passes through the magnet 418 and exerts pressure on the piston 438 to move the piston 438 in the direction 452 toward the proximal 316 end of the sleeve 220. However, the DOCC 204 also includes a biasing mechanism 454 to urge the piston 438 to move in a direction 456 toward the DOC element 300. In the illustrated embodiment, the biasing mechanism 454 is a compression spring. However, the biasing mechanism 454 may be any suitable device (e.g., a hydraulic device, a magnetic device, other spring mechanisms, etc.) for urging the piston 438 to move toward the DOC element 300.

Figure 5:
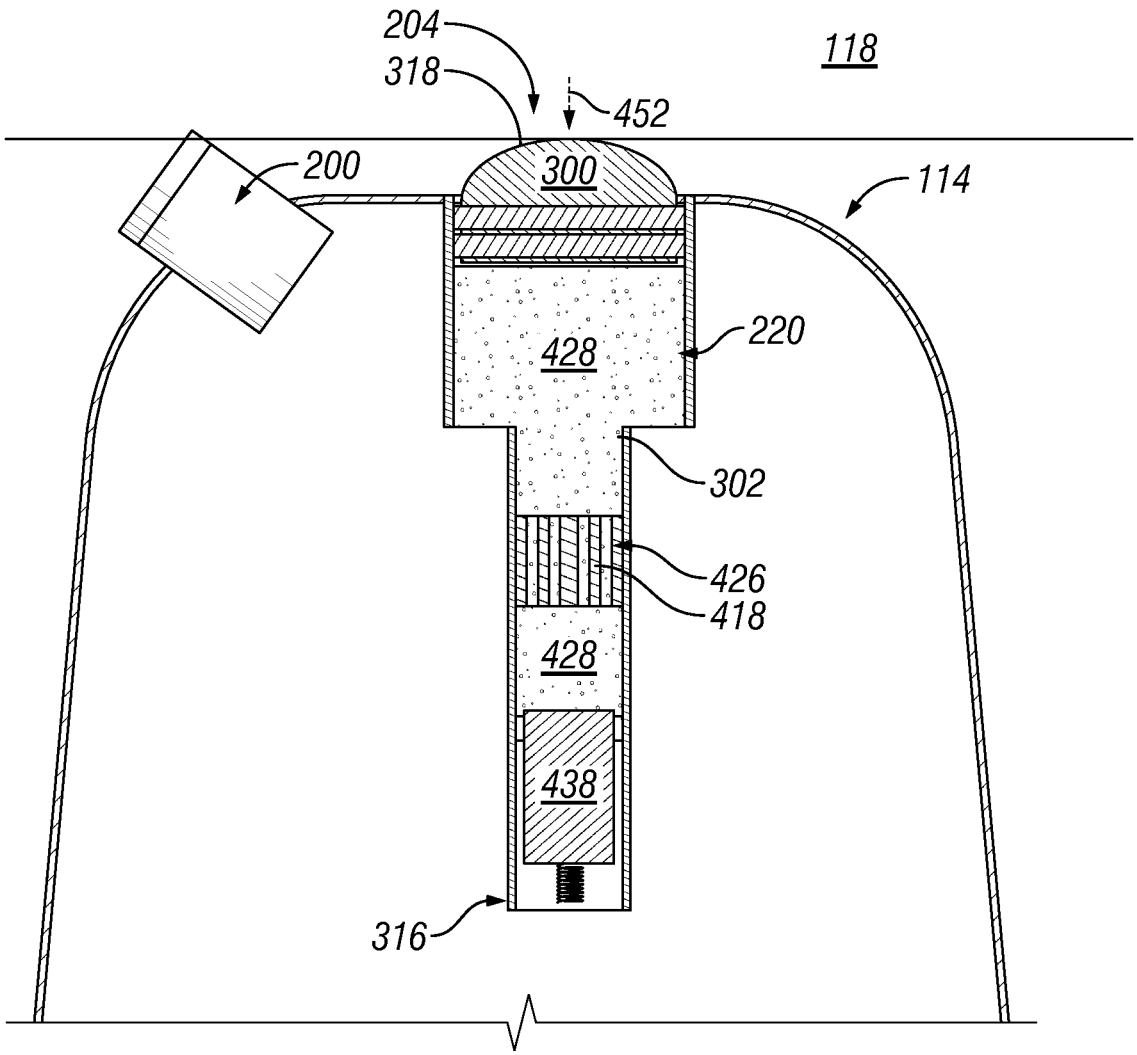
FIG. 5 illustrates a cross-sectional view of the drill bit having the DOCC of FIG. 4 with the DOC element in a retracted position.

FIG. 5 illustrates a cross-sectional view of the drill bit having the depth of cut controller (DOCC) 204 of FIG. 4 with the DOC element 300 in a retracted position. As set forth above in FIG. 4, the external forces on the working face 318 of the DOC element 300 may cause the DOC element 300 to move in the direction 452 toward the proximal end 316 of the sleeve 220. That is, the external forces move the DOC element 300 toward the illustrated retracted position. Movement of the DOC element 300 and the piston 438 causes the magnetic fluid 428 housed in the axial bore 302 between the DOC element 300 and the piston 438 to move along the axial bore 302. As the magnetic fluid 428 moves along the axial bore 302, at least a portion of the magnetic fluid 428 passes through the fluid passageways 426 extending through the magnet 418. The magnetic fluid 428 becomes strongly magnetized in the presence of a magnetic field of the magnet 418. Further, the magnetic fluid 428 experiences an increase in viscosity due to exposure to the magnetic field of the magnet 418. As set forth in detail below, the magnetic fluid 428 provides variable resistance to movement of the DOC element 300 based at least in part on the viscosity of the magnetic fluid 428.

As the magnetic fluid 428 passes through the magnet 418, the magnetic field from the magnetic causes a reaction in the magnetic fluid 428 that temporarily increases the viscosity of the magnetic fluid 428 while the magnetic fluid 428 is within magnetic field. As the viscosity of the magnetic fluid 428 increases, the magnetic fluid 428 provides increased resistance to movement of the DOC element 300 toward the proximal end 316 of the sleeve 220. Moreover, a higher external force on the working face 318 of the DOC element 300 may result in a higher increase in the viscosity of magnetic fluid 428 than a lower external force on the working face 318. A higher external force may initially cause a higher flow rate of the magnetic fluid 428 through the magnet 418. As set forth above, the magnetic field may temporarily increase the viscosity of the magnetic fluid 428. As the magnetic fluid 428 flows past the magnet 418 toward the proximal end of the sleeve 220, the magnetic fluid 428 may return to its original (lower) viscosity after a predetermined time from moving outside of the magnetic field of the magnet 418. As such, the higher flow rate may result in a larger amount of the magnetic fluid 428 having the higher viscosity after moving outside of the magnetic field of the magnetic 418 than a lower flow rate, which results in a higher overall viscosity of the magnetic fluid 428 for a higher external force than a lower external force on the working face 318 of the DOC element 300.

During drilling operations, drilling through hard subterranean formations 118 may result in higher external forces on the working face 318 than when drilling through soft subterranean formations 118. Accordingly, the viscosity of the magnetic fluid 428 may be greater when drilling through hard subterranean formations 118 than when drilling through soft subterranean formations 118 such that the magnetic fluid 428 provides greater resistance to movement of the DOC element 300 toward the illustrated retracted position when drilling through hard subterranean formations 118. Providing greater resistance to movement of the DOC element 300 may provide increased depth of cut control by countering the external forces acting on drill bit 114 and limiting the engagement of fixed cutters 200 with the formation 118.

Figure 6:
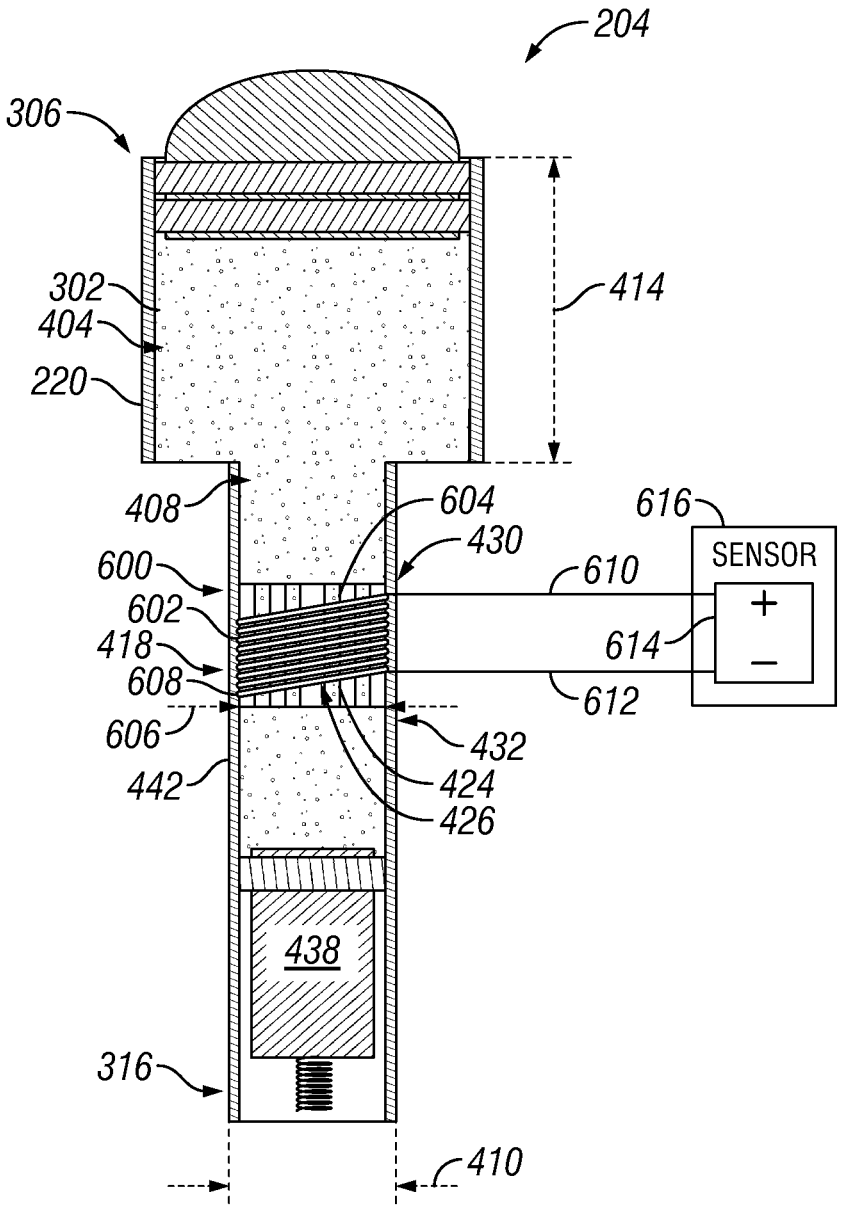
FIG. 6 illustrates a cross-sectional view of the DOCC of FIG. 4 having an electromagnet.

FIG. 6 illustrates a cross-sectional view of the depth of cut controller (DOCC) 204 of FIG. 4 having an electromagnet. As set forth above, the DOCC 204 includes the housing (e.g., sleeve 220) having the axial bore 302 with the variable diameter extending into the sleeve 220 from the distal end 306 toward the proximal end 316 of the sleeve 220. The DOC element 300 is positioned at least partially within the first portion 404 of the axial bore 302 and moves along the length 414 of the first portion 404 of the axial bore 302 to extend or retract with respect to the sleeve 220. Moreover, the DOCC 204 includes the magnet 418 secured within the axial bore 302 of the sleeve 220 between the DOC element 300 and the proximal end 316 of the sleeve 220. As set forth above, the magnet 418 causes a reaction in the magnetic fluid 428 passing through the magnetic field of the magnet 418 that temporarily increases the viscosity of the magnetic fluid 428, which provides increased resistance to movement of the DOC element 300 toward the proximal end 316 of the sleeve 220.

As illustrated in FIG. 6, the magnet 418 is an electromagnet 600 positioned in the second portion 408 of the axial bore 302 between the DOC element 300 and the piston 438. The electromagnet 600 includes a wire coil 602 wrapped around a core 604. In examples, the core 604 is a cylindrical core that extends axially along the second portion 408 of the axial bore 302. However, the core 604 may include any suitable shape and/or orientation. For example, the core 604 may extend laterally across the second portion 408 of the axial bore 302. Moreover, a magnet diameter 606 of the electromagnet 600 (e.g., wire coil 602 wrapped around the core 604) may be substantially similar to the second bore diameter 410 of the second portion 408 of the axial bore 302 such that the electromagnet 600 spans across the second portion 408 of the axial bore 302. As such, the electromagnet 600 may at least partially block flow of the magnetic fluid 428 along the second portion 408 of the axial bore 302. To permit the magnetic fluid 428 to flow between the distal end 430 of the electromagnet 600 and the proximal end 432 of the electromagnet 600, the electromagnet 600 has the multiple through bores 424 that form the fluid passageways 426 through the core 604 of the electromagnet 600. Alternatively, the magnet diameter 606 of the electromagnet 600 may be smaller than the second bore diameter 410 of the second portion 408 such that the magnetic fluid 428 may flow around the electromagnet 600 between a radial surface 608 of the electromagnet 600 and the borehole wall 442 of the second portion 408 of the axial bore 302.

Moreover, the wire coil 602 of the electromagnet 600 includes a positive end 610 and a negative end 612 that connect to a power source 614. In the illustrated embodiment, the power source 614 includes a battery for powering a sensor 616 disposed adjacent the DOCC 204. However, the power source 614 may include any suitable source of current for the electromagnet 600. That is, the power source 614 may be any source of current capable of providing sufficient current to activate the electromagnet 600 such that the electromagnet 600 emits the magnetic field that causes the magnetic fluid 428 to experience the increase in viscosity in the presence of the magnetic field.

Figure 7:
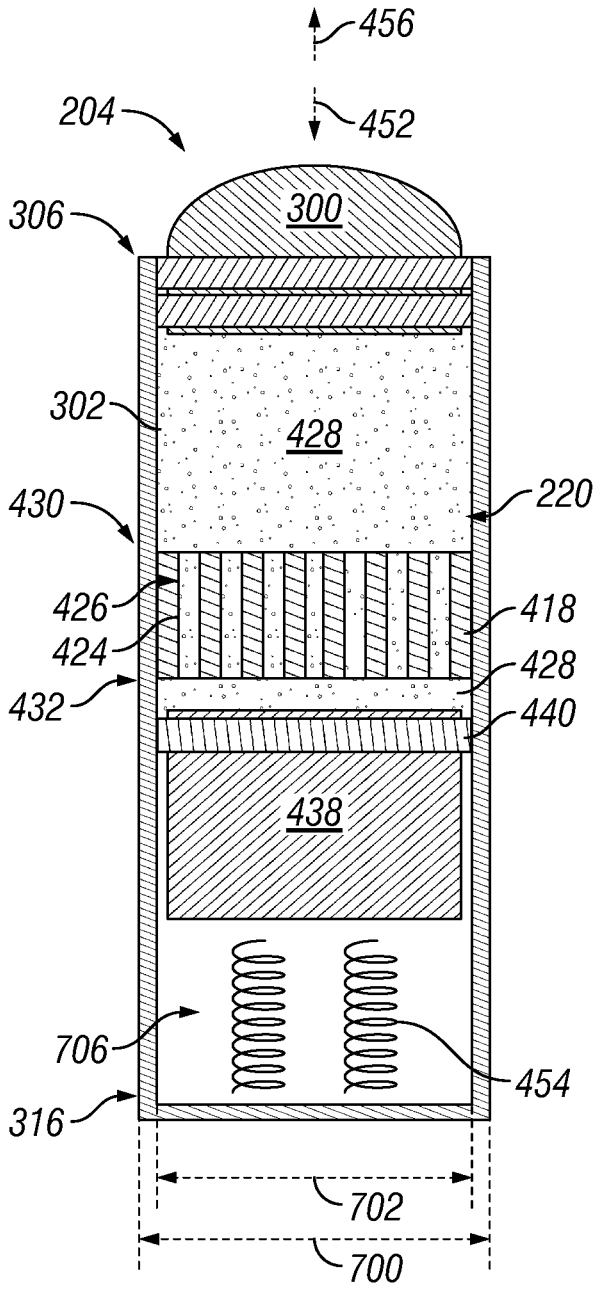
FIG. 7 illustrates a cross-sectional view of another example of the DOCC.

FIG. 7 illustrates an isometric view of another example of a depth of cut controller (DOCC) 204. The DOCC 204 includes the housing (e.g., sleeve 220) for housing the various other components (e.g., the depth of control (DOC) element 300, the magnetic fluid 428, the magnet 418, the piston 438, the seals 440, and the biasing mechanism 454). In the illustrated embodiment, the sleeve 220 has a uniform outer diameter 700. Having the uniform outer diameter 700 may reduce cost and difficulty of manufacturing and installation as compared to the DOCC 204 having the non-uniform outer diameter (e.g., referring to FIG. 4). Further, the sleeve 220 includes the axial bore 302 having a uniform bore diameter 702 along the length 400 of the axial bore 302. Alternatively, the axial bore 302 may have a variable diameter along the length 400 of the axial bore 302 such that the axial bore 302 includes the first portion 404 having the first bore diameter 406 and the second portion 408 having the second bore diameter 410 (as best shown in FIGS. 4-6).

With continued reference to FIG. 7, the DOC element 300 is positioned at least partially within the axial bore 302. The DOC element 300 moves axially along the axial bore 302 between the distal end 306 of the sleeve 220 and the magnet 418 to extend or retract with respect to the sleeve 220. The magnet 418 is secured within the axial bore 302 of the sleeve 220 between the DOC element 300 and the proximal end 316 of the sleeve 220. The magnet 418 has a generally cylindrical shape with multiple through bores 424 that form the fluid passageways 426 through the magnet 418. The fluid passageways 426 permit the magnetic fluid 428 to flow between the distal end 430 of the magnet 418 and a proximal end 432 of the magnet 418. The magnetic fluid 428 (e.g., ferrofluid, magnetorheological fluid, etc.) is housed within the axial bore 302 of the sleeve 220 between the DOC element 300 and the proximal end 316 of the sleeve 220. In the illustrated embodiment, the magnetic fluid 428 is housed in the axial bore 302 between the DOC element 300 and the piston 438. The seal 440 is disposed between the piston 438 and the borehole wall 704 of the axial bore 302 to prevent the magnetic fluid 428 from passing around the piston 438 into the end portion 706 of the axial bore 302 disposed between the piston 438 and the proximal end 316 of the sleeve 220. The piston 438 is configured to move along the axial bore 302 between the magnet 418 and the proximal end 316 of the sleeve 220. As set forth above, the external forces on the working face 318 of the DOC element 300 may cause the DOC element 300 to move in the direction 452 toward the proximal end 316 of the sleeve 220. As the DOC element 300 moves, the DOC element 300 pushes the magnetic fluid 428, which passes through the magnet 418 and exerts pressure on the piston 438 to move the piston 438 in the direction 452 toward the proximal end 316 of the sleeve 220. However, as the magnetic fluid 428 passes through the magnet 418, the magnetic field from the magnetic causes a reaction in the magnetic fluid 428 that temporarily increases the viscosity of the magnetic fluid 428, which provides increased resistance to movement of the DOC element 300 toward the proximal end 316 of the sleeve 220. Moreover, the biasing mechanism 454 urges the piston 438 to move in the direction 456 toward the DOC element 300. As set forth above, controlling movement of the DOC element 300 via the biasing mechanism 454 and the magnetic fluid 428 may provide depth of cut control for the DOCC 204.

Figure 8:
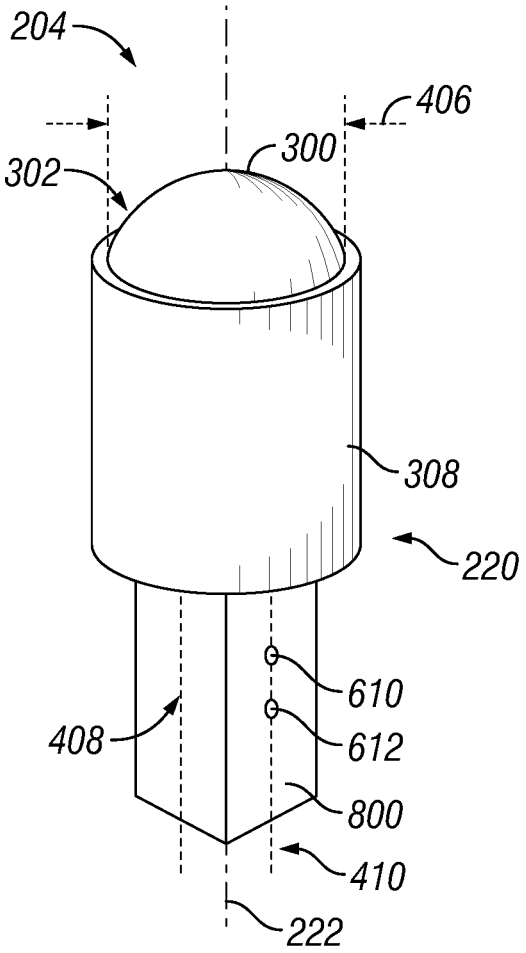
FIG. 8 illustrates an isometric view of another example of the DOCC having a non-uniform outer surface.

FIG. 8 illustrates an isometric view of another example of a depth of cut controller (DOCC) 204 having a non-uniform outer surface. The DOCC 204 includes the housing (e.g., sleeve 220) for housing various other components including the depth of control (DOC) element 300. In the illustrated embodiment, the sleeve 220 has a non-uniform outer shape. Specifically, the sleeve 220 includes the first cylindrical portion 308 and a second rectangular prism portion 800. The second rectangular prism portion 800 having a square cross-section along the central axis 222 of the sleeve 220 and/or DOCC 204. The sleeve 220 includes the axial bore 302 having a variable diameter (e.g., referring to FIGS. 4 and 5). The first portion 404 (e.g., referring to FIGS. 4 and 5) of the axial bore 302 is disposed within the first cylindrical portion 308 and the second portion 408 of the axial bore 302 is disposed in the second rectangular prism portion 800. The first bore diameter 406 of the first portion 404 is greater than the second bore diameter 410 of the second portion 408. Alternatively, the axial bore 302 may include the uniform bore diameter 702 along the length 400 of the axial bore 302 (e.g., referring to FIG. 7).

The second rectangular prism portion 800 may facilitate ease of installation for the DOCC 204 having the electromagnet 600 (e.g., referring to FIG. 6). As set forth above in FIG. 6, the electromagnet 600 includes the positive end 610 of the wire coil 602 connected to a positive connection of the power source 614 (e.g., referring to FIG. 6) and the negative end 612 of the wire coil 602 connected to a negative connection of the power source 614 to active the electromagnet 600. The sleeve 220 of the DOCC 204 may require a particular angular orientation with respect to the controller pocket 216 of the blade 206 of the drill bit 144 (e.g., referring to FIG. 2) to align the positive end 610 and the negative end 612 of the wire coil 602 with their respective connections such that the positive end 610 and negative end 612 of the wire coil 602 may connect to the power source 614. The second rectangular prism portion 800 may facilitate installation by reducing a number of potential alignments of the sleeve 220 within the controller pocket 216 (e.g., referring to FIG. 2). Further, the second rectangular prism portion 800 may inhibit rotation of the sleeve 220 with respect to the controller pocket 216 (e.g., referring to FIG. 2) during and/or after installation such that the positive end 610 and the negative end 612 of the wire coil 602 maintain alignment with their respective connections.

Figure 9:
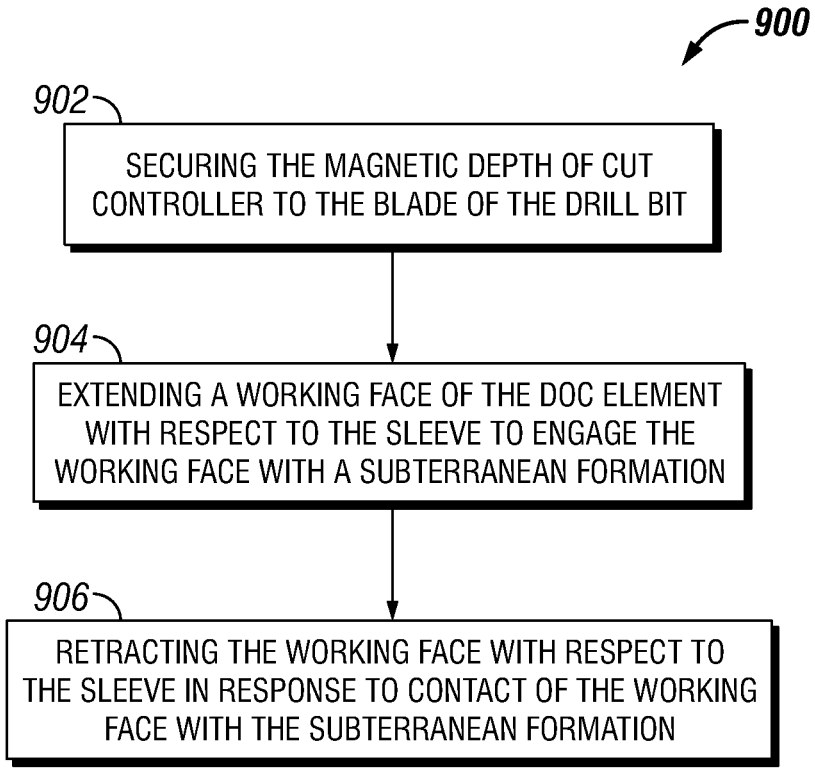
FIG. 9 is method for providing depth of cut control with the depth of cut controller DOCC.

FIG. 9 is method for providing depth of cut control. The method 900 includes the step (block 902) of securing the magnetic depth of cut controller to the blade of the drill bit. The magnetic depth of cut controller has the sleeve 220 (e.g., referring to FIG. 2) with the axial bore 302 (e.g., referring to FIG. 3) extending into a body portion of the sleeve 220, the depth of cut (DOC) element positioned at least partially within the axial bore 302, the magnet 418 (e.g., referring to FIG. 4) secured within the axial bore 302 of the sleeve 220 between the DOC element 300 (e.g., referring to FIG. 3) and the proximal end of the sleeve 220, and the magnetic fluid 428 (e.g., referring to FIG. 4) housed within the axial bore 302 of the sleeve 220 between the DOC element 300 and the proximal end of the sleeve 220. During drilling operations, the external forces on the DOCC 204 may cause the DOC element 300 to move with respect to the sleeve 220. Movement of the DOC element 300 pushes magnetic fluid 428 to move along the axial bore 302 and through the magnet 418. The magnetic field interacts with the magnetic fluid 428 to increase the viscosity of the magnetic fluid 428 such that the viscosity of the magnetic fluid 428 changes responsive to proximity to the magnet 418.

The method also includes the step (block 904) of extending a working face 318 (e.g., referring to FIG. 3) of the DOC element 300 with respect to the sleeve 220 to engage the working face 318 with a subterranean formation 118. As set forth above, the magnetic fluid 428 is disposed between the DOC element 300 and the piston 438 (e.g., referring to FIG. 4) within the axial bore 302. The DOCC 204 includes the biasing mechanism 454 (e.g., spring) that urges the DOC element 300 to extend outward respect to the sleeve 220. The sleeve 220 extends in response to a biasing force of the biasing mechanism 454 (e.g., referring to FIG. 4) exceeding the external forces on the working face 318 of the DOC element 300.

The method further includes the step (block 906) of retracting the working face 318 with respect to the sleeve 220 in response to contact of the working face 318 with the subterranean formation 118 (e.g., the external forces). The magnetic fluid 428 provides variable resistance to movement of the working face 318 with respect to the sleeve 220 based at least in part on the viscosity of the magnetic fluid 428. Specifically, as the magnetic fluid 428 passes through the magnet 418, the magnetic field from the magnetic causes a reaction in the magnetic fluid 428 that increases the viscosity of the magnetic fluid 428. As the viscosity of the magnetic fluid 428 increases, the magnetic fluid 428 provides increased resistance to movement of the DOC element 300 toward the proximal end of the sleeve 220. Providing increased resistance to movement of the DOC element 300 may provide increased depth of cut control by countering the external forces acting on drill bit 301 and limiting the engagement of cutting elements 328 and/or 329 with the formation 118.

Accordingly, embodiments of the preceding description provide a drill bit having magnetic depth of cut controller, for example, provides reactive depth of cut control for fixed cutters of the drill bit, which may lead to stick-slip or other issues that may damage parts of the drill string and/or hinder the efficiency of drilling operations. The systems, methods, and apparatus may include any of the various features disclosed herein, including one or more of the following statements.

Statement 1. A magnetic depth of cut controller (DOCC may comprise a housing having a body portion with a bore extending into the body portion; a depth of cut (DOC) element positioned at least partially within the bore and having a working face to engage a subterranean formation, the DOC element moveable within the bore to extend or retract from a first end of the housing; a magnet secured within the bore of the housing between the DOC element and a second end of the housing; and a magnetic fluid disposed within the bore of the housing between the DOC element and the second end of the housing, the magnetic fluid having a viscosity that changes responsive to proximity to the magnet to provide a variable resistance to movement of the DOC element.

Statement 2. The magnetic DOCC of statement 1, wherein the viscosity of the magnetic fluid is based at least in part on a rate of flow of the magnetic fluid through a magnetic field of the magnet.

Statement 3. The magnetic DOCC of any proceeding statement, wherein a first flow rate of the magnetic fluid increases the viscosity of the magnetic fluid by more than a second flow rate that is less than the first flow rate.

Statement 4. The magnetic DOCC of any proceeding statement, further comprising a piston moveably positioned within the bore between the second end of the housing and the magnetic fluid.

Statement 5. The magnetic DOCC of statement 4, further comprising a spring disposed between the second end of the housing and the piston to bias the piston in a direction toward the DOC element.

Statement 6. The magnetic DOCC of statements 1-4, wherein the bore has a uniform diameter along a length of the bore.

Statement 7. The magnetic DOCC of statements 1-4 or 6, wherein the bore has a variable diameter along the length of the bore.

Statement 8. The magnetic DOCC of statements 1-4, 6, and 7, wherein a diameter of the bore decreases along the length of the bore from a first end of the housing in a direction toward a second end of the housing.

Statement 9. The magnetic DOCC of statements 1-4, 6, 7, and 8, wherein the bore includes a first portion having a first diameter, and a second portion having a second diameter that is less than the first diameter, the first portion being disposed proximate the first end of the housing and the second portion be disposed proximate the second end of the housing.

Statement 10. The magnetic DOCC of statement 9, wherein the housing includes a sleeve with a first cylindrical portion and a second cylindrical portion, and wherein the sleeve is configured to be secured within a pocket formed in a blade of a drill bit.

Statement 11. The magnetic DOCC of statement 9, wherein the magnet is positioned within the second portion, the magnet having at least one through bore for the magnetic fluid to flow through the magnet.

Statement 12. The magnetic DOCC of statements 1-4 or 6-9, wherein the magnet includes at least one of fluid passageway to permit the magnetic fluid to pass through and/or around that magnet from a first side of the magnet to a second side of the magnet.

Statement 13. A drill bit may comprise a bit body; a plurality of blades disposed on the bit body and having a plurality of cutter pockets formed therein; a plurality of fixed cutters secured within the cutter pockets on the blades; a housing having a body portion with a bore extending into the body portion, the housing secured within a blade of the plurality of blades; a depth of cut (DOC) element positioned at least partially within the bore and having a working face to engage a subterranean formation, the DOC movable within the bore to extend or retract from a first end of the housing; a magnet secured within the bore of the housing between the DOC element and a second end of the housing; and a magnetic fluid disposed within the bore of the housing between the DOC element and the second end of the housing, the magnetic fluid having a viscosity that changes responsive to proximity to the magnet to provide a variable resistance to movement of the DOC element.

Statement 14. The drill bit of statement 13, wherein each cutter pocket of the cutter pockets is formed in a leading portion of a respective blade of the plurality of blades, and the housing is secured in a trailing portion of the respective blade.

Statement 15. The drill bit of statements 13 or 14, wherein the bore is an axial bore extending along a central axis of the housing, at least a portion of the housing having a cylindrical shape.

Statement 16. The drill bit of any of statements 13-15, further comprising a biasing mechanism and a piston moveably positioned within the bore between the second end of the housing and the magnetic fluid, the biasing mechanism urging the piston to move in a direction toward the DOC element.

Statement 17. The drill bit of any of statements 13-16, wherein the bore includes a first portion having a first diameter, and a second portion having a second diameter that is less than the first diameter, the first portion being disposed proximate a first end of the housing and the second portion being disposed proximate the second end of the housing.

Statement 18. The drill bit of any of statement 17, wherein a length of the first portion is greater than a length of the second portion.

Statement 19. The drill bit of any of statements 17 or 18, wherein the magnet is positioned within the second portion, the magnet having at least one through bore for the magnetic fluid to flow through the magnet.

Statement 20. A method for providing depth of cut control may comprise extending a working face of a depth of cut (DOC) element with respect to a housing to engage the working face with a subterranean formation, the housing being secured within a blade of a drill bit; and retracting the working face with respect to the housing in response to contact of the working face with the subterranean formation, wherein a magnetic fluid in the housing provides variable resistance to movement of the working face responsive to the viscosity of the magnetic fluid.

It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A magnetic depth of cut controller (DOCC), comprising:

a housing having a body portion with a bore extending into the body portion;

a depth of cut (DOC) element positioned at least partially within the bore and having a working face to engage a subterranean formation, the DOC element moveable within the bore to extend or retract from a first end of the housing;

a rare earth magnet secured within the bore of the housing between the DOC element and a second end of the housing; and a magnetic fluid disposed within the bore of the housing between the DOC element and the second end of the housing, the magnetic fluid having a viscosity that changes responsive to proximity to the rare earth magnet to provide a variable resistance to movement of the DOC element.

2. The magnetic DOCC of claim 1, wherein the viscosity of the magnetic fluid is based at least in part on a rate of flow of the magnetic fluid through a magnetic field of the rare earth magnet.

3. The magnetic DOCC of claim 1, wherein a first flow rate of the magnetic fluid increases the viscosity of the magnetic fluid by more than a second flow rate that is less than the first flow rate.

4. The magnetic DOCC of claim 1, further comprising a piston moveably positioned within the bore between the second end of the housing and the magnetic fluid.

5. The magnetic DOCC of claim 4, further comprising a spring disposed between the second end of the housing and the piston to bias the piston in a direction toward the DOC element.

6. The magnetic DOCC of claim 1, wherein the bore has a uniform diameter along a length of the bore.

7. The magnetic DOCC of claim 1, wherein the bore has a variable diameter along the length of the bore.

8. The magnetic DOCC of claim 1, wherein a diameter of the bore decreases along the length of the bore from a first end of the housing in a direction toward a second end of the housing.

9. The magnetic DOCC of claim 1, wherein the bore includes a first portion having a first diameter, and a second portion having a second diameter that is less than the first diameter, the first portion being disposed proximate the first end of the housing and the second portion be disposed proximate the second end of the housing.

10. The magnetic DOCC of claim 9, wherein the housing includes a sleeve with a first cylindrical portion and a second cylindrical portion, and wherein the sleeve is configured to be secured within a pocket formed in a blade of a drill bit.

11. The magnetic DOCC of claim 9, wherein the rare earth magnet is positioned within the second portion, the rare earth magnet having at least one through bore for the magnetic fluid to flow through the magnet.

12. The magnetic DOCC of claim 1, wherein the rare earth magnet includes multiple through bores that form fluid passageways to permit the magnetic fluid to pass through and/or around the rare earth magnet from a first side of the rare earth magnet to a second side of the rare earth magnet.

13. A drill bit, comprising:

a bit body;

a plurality of blades disposed on the bit body and having a plurality of cutter pockets formed therein;

a plurality of fixed cutters secured within the cutter pockets on the blades;

a housing having a body portion with a bore extending into the body portion, the housing secured within a blade of the plurality of blades;

a depth of cut (DOC) element positioned at least partially within the bore and having a working face to engage a subterranean formation, the DOC movable within the bore to extend or retract from a first end of the housing;

a magnet secured within the bore of the housing between the DOC element and a second end of the housing; and a magnetic fluid disposed within the bore of the housing between the DOC element and the second end of the housing, the magnetic fluid having a viscosity that changes responsive to proximity to the magnet to provide a variable resistance to movement of the DOC element, and wherein the magnet comprises multiple through bores that form fluid passageways to permit the magnetic fluid to pass through the magnet from a first side of the magnet to a second side of the magnet.

14. The drill bit of claim 13, wherein each cutter pocket of the cutter pockets is formed in a leading portion of a respective blade of the plurality of blades, and the housing is secured in a trailing portion of the respective blade.

15. The drill bit of claim 13, wherein the bore is an axial bore extending along a central axis of the housing, at least a portion of the housing having a cylindrical shape.

16. The drill bit of claim 13, further comprising a biasing mechanism and a piston moveably positioned within the bore between the second end of the housing and the magnetic fluid, the biasing mechanism urging the piston to move in a direction toward the DOC element.

17. The drill bit of claim 13, wherein the bore includes a first portion having a first diameter, and a second portion having a second diameter that is less than the first diameter, the first portion being disposed proximate a first end of the housing and the second portion being disposed proximate the second end of the housing.

18. The drill bit of claim 17, wherein a length of the first portion is greater than a length of the second portion.

19. The drill bit of claim 17, wherein the magnet comprises a rare earth magnet.

20. A method for providing depth of cut control, comprising:

extending a working face of a depth of cut (DOC) element from a first end of a housing to engage the working face with a subterranean formation, the housing being secured within a blade of a drill bit, wherein the DOC element is positioned at least partially within a bore of the housing and is moveable along the bore, and wherein a rare earth magnet is secured within the bore between the DOC element and a second end of the housing; and retracting the working face with respect to the housing in response to contact of the working face with the subterranean formation, wherein a magnetic fluid disposed within the bore of the housing, between the DOC element and the second end of the housing, provides variable resistance to movement of the working face responsive to the viscosity of the magnetic fluid, and wherein the viscosity of the magnetic fluid is configured to change in response to proximity to the rare earth magnet.

* * * * *